US006786432B1

(12) United States Patent
Reiter

(10) Patent No.: US 6,786,432 B1
(45) Date of Patent: Sep. 7, 2004

(54) METHOD FOR ADJUSTING THE VALVE LIFT OF AN INJECTION VALVE

(75) Inventor: Ferdinand Reiter, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 214 days.

(21) Appl. No.: 10/031,295

(22) PCT Filed: Jul. 14, 2000

(86) PCT No.: PCT/DE00/02337

§ 371 (c)(1),
(2), (4) Date: May 30, 2002

(87) PCT Pub. No.: WO01/04487

PCT Pub. Date: Jan. 18, 2001

(30) Foreign Application Priority Data

Jul. 14, 1999 (DE) ..... 199 32 762

(51) Int. Cl.[7] ..... B05B 1/30; F02D 1/06; F02M 47/02

(52) U.S. Cl. ..... 239/585.1; 239/5; 239/88; 239/533.3; 239/585.5

(58) Field of Search ..... 239/585.1, 585.2, 239/585.3, 585.4, 585.5, 533.2, 533.3, 533.13, 5, 88–94, 95, 533.11, 900, 588; 251/129.15, 129.21

(56) References Cited

U.S. PATENT DOCUMENTS 4,528,959 A * 7/1985 Hauser, Jr. ..... 123/470
5,365,906 A * 11/1994 Deweerdt ..... 123/467
6,481,421 B1 * 11/2002 Reiter ..... 123/470

FOREIGN PATENT DOCUMENTS

| | | | |
|---|---|---|---|
| DE | 26 33 820 A1 * | 2/1978 | ..... F02M/55/00 |
| DE | 196 40 782 | 4/1998 | |
| DE | 197 23 953 | 12/1998 | |
| DE | 197 44 739 | 4/1999 | |
| EP | 497 931 | 8/1992 | |
| JP | 11 324 851 | 11/1999 | |

* cited by examiner

*Primary Examiner*—Davis Hwu
(74) *Attorney, Agent, or Firm*—Kenyon & Kenyon

(57) ABSTRACT

The present invention relates to a method for adjusting the valve lift of an injector, especially a fuel injector for mixture-compressing externally ignited internal combustion engines. The valve has a fuel intake, an energizable actuation device, which moves a valve needle having a valve closing component, a fixed valve seat formed on a valve seat element, with which the valve closing component interacts for opening and closing the valve, and a fuel outlet. Furthermore, the valve has a valve seat support provided with an internal longitudinal opening for accepting the valve needle. The valve needle executes a lift between a valve closing position and a valve opening position. The valve seat support is preformed having at least one radially-outward-protruding raised section. In order to change the lift of the valve needle, the raised section is plastically deformed in radial direction toward the longitudinal opening.

12 Claims, 2 Drawing Sheets

METHOD FOR ADJUSTING THE VALVE LIFT OF AN INJECTION VALVE

FIELD OF THE INVENTION

The present invention relates to a method for adjusting the valve lift of an injector.

BACKGROUND INFORMATION

A method for manufacturing a valve is already known (European Patent No. 497 931) where, for the purpose of adjusting the valve needle lift, a valve seat part, having a valve seat body and an orifice body, is deformed between two welds, which may result in damage to the welds and deformations of the valve seat body.

Furthermore, from German Published Patent Application No. 196 40 782, a method is already known for adjusting the valve lift on an injector, where the valve seat support is plastically deformed by applying a constriction on the circumference of the valve seat support. The deformation is always performed starting with a tube- or sleeve-shaped cylindrical component. In other words, the deformation of the valve seat support is used directly for adjusting the valve lift.

SUMMARY OF THE INVENTION

The method according to the present invention for adjusting the valve lift of an injector has the advantage that the lift of the valve needle is easily adjustable, without risking an undesirable effect of force on the valve seat element.

Of particular advantage is the fact that the valve lift can be adjusted in a precise and defined way. Compared to known lift adjustment methods, the method according to the present invention permits a reliable adjustment with even tighter tolerances.

It is of particular advantage to design the at least one raised section at the connection piece/valve seat support so that it wraps around 360°. The raised section can be applied in the form of a bead, especially by rolling.

The deformation tools bringing about the deformation of the raised section act advantageously on the raised section in radial direction. When a deformation tool applies an axial force to the raised section, the deformation tool is configured so that the deformation direction of the raised section is nevertheless radial.

DETAILED DESCRIPTION

Figure 1:
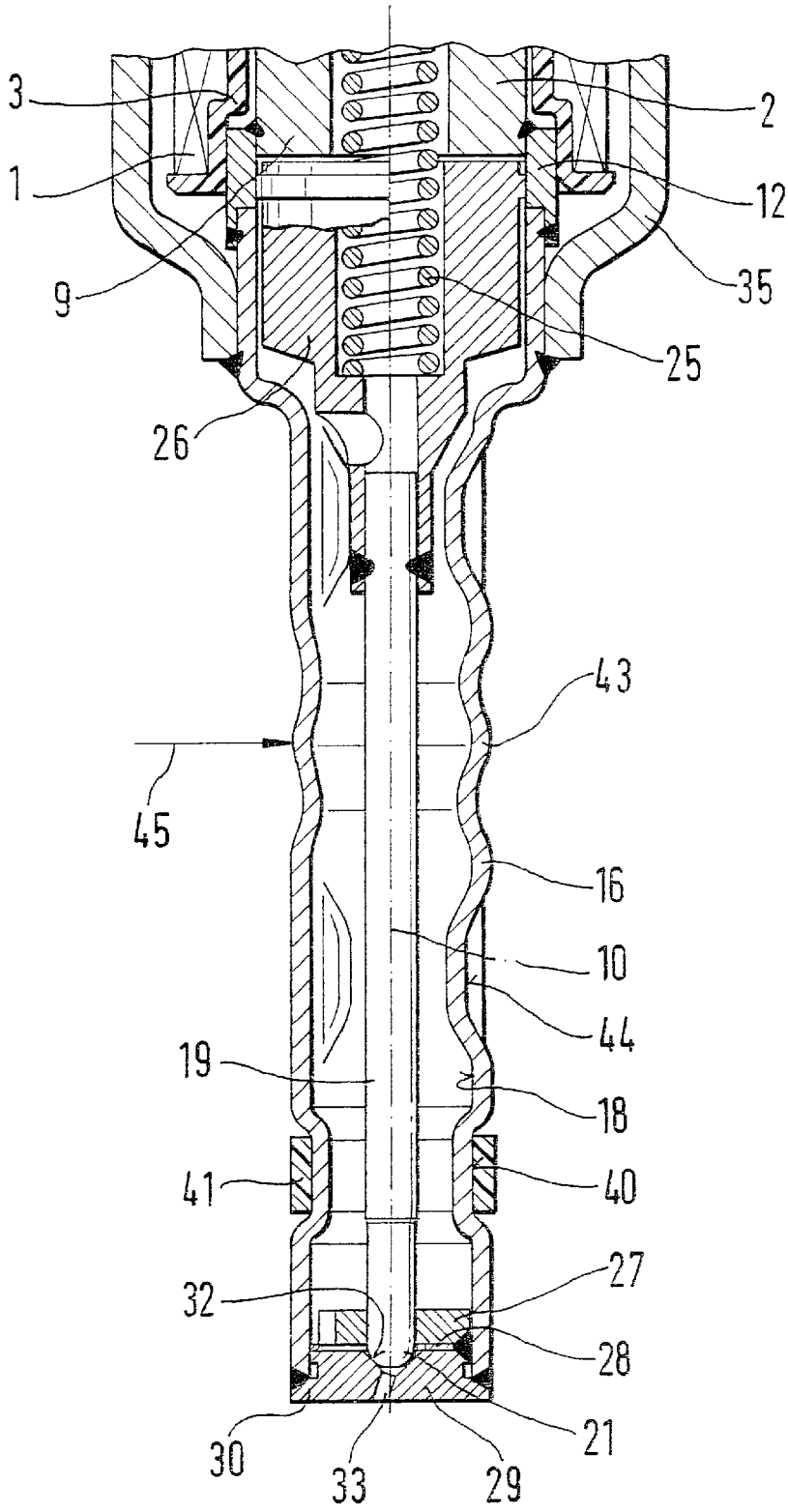
FIG. 1 shows an embodiment of an injector, on which a lift adjustment according to the present invention is possible.

The electromagnetically actuated valve, partially shown in FIG. 1, in the form of a fuel injector for fuel injection systems of mixture-compressing, externally ignited internal combustion engines, is particularly suitable for direct injection of fuel into a combustion chamber not shown here. The fuel injector has tube-shaped core 2, surrounded by solenoid 1, as a so-called internal pole. Bobbin 3 takes up a winding of solenoid 1 and, in conjunction with core 2, makes possible a particularly compact construction of the injector in the area of solenoid 1. Piezoelectric actuators or magnetostrictive actuators are also suitable as energizable actuating elements, instead of an electromagnetic circuit.

A tube-shaped metallic intermediate piece 12 is connected in an impervious manner, for example by welding, to lower core edge 9 of core 2, concentric to a valve longitudinal axis 10, and partially surrounds core edge 9 in an axial fashion. A largely tube-shaped valve seat support 16 which, however, has been preformed for the method according to the present invention for adjusting the valve lift, extends downstream from bobbin 3 and intermediate piece 12, and is, for instance, firmly connected to intermediate piece 12. Valve seat support 16, serving as connecting piece and representing a thin-walled sleeve, has a longitudinal opening 18. Located in longitudinal opening 18 is a, for instance, rod-shaped, valve needle 19, having valve-closing section 21 at its downstream end.

The injector is actuated in known fashion, for instance electromagnetically. The electromagnetic circuit with solenoid 1, core 2 and an armature 26 is used for the axial movement of valve needle 19 and, therefore, opening against the resilience of a resetting spring 25, or closing of the injector. Armature 26 is connected by a weld to the end of the valve needle 19 facing away from valve closing section 21, and aligned with core 2. A guide and seat unit is tightly welded into longitudinal opening 18 of the downstream end of valve seat support 16, facing away from core 2.

This guide and seat unit has three disk-shaped elements, whose end faces are in direct contact with each other. Guide element 27, swirl element 28 and valve seat element 29 follow in succession in downstream direction. While guide element 27 and swirl element 28 are situated completely within longitudinal opening 18, valve seat element 29, with its stepped outer contour, extends only partially into longitudinal opening 18. In the area of an outward-protruding shoulder 30, valve seat element 29 is connected firmly and tightly to valve seat support 16 at its downstream end face. Guide element 27, swirl element 28 and valve seat element 29 are also firmly connected to each other, with a weld presenting itself at the outer circumference of the three elements 27, 28 and 29.

A guide opening in intermediate component 12 and a guide opening in guide element 27 are used to guide valve needle 19 along longitudinal valve axis 10 during the axial motion. Valve closing section 21 which, for example, forms a conical taper in the downstream direction, interacts with valve seat surface 32 of valve seat element 29, with valve seat surface 32 having a conical-frustum-shaped taper in the direction of flow. Starting from valve seat surface 32, at least one outlet opening 33 extends through valve seat element 29. In the embodiment shown, outlet opening 33 is positioned obliquely relative to longitudinal valve axis 10 which terminates in a convex-shaped injection region of valve seat element 29. The fuel passing through outlet opening 33 has a swirl, since an atomization-enhancing swirl component was imparted to it from valve seat surface 32 in swirl element 28 having, for example, multiple tangentially-extending swirl channels.

With solenoid 1 in the non-energized state, an end position of valve needle 19 is determined by contact of valve closing section 21 with valve seat surface 32 while, with solenoid 1 in the energized state, the other end position of valve needle 19 results from contact of armature 26 with core end 9 of core 2. The distance between the two end positions represents the valve lift which is adjustable according to the present invention. Solenoid 1 is surrounded by a cup-shaped valve housing 35 which acts as the outer pole. With its lower end facing valve seat element 29, valve housing 35 is permanently attached to valve seat support 16, e.g., by a weld.

Valve seat support 16 made, for instance, of a ferritic material conducting the magnetic flux, surrounds the axially movable valve component which includes armature 26 and valve needle 19 along with valve closing section 21, as well as part of the guide and seat unit. Valve seat support 16 is elongated and may even constitute half or more of the entire axial extension of the injector. This design of valve seat support 16 allows the injection point of the injector to be considerably advanced, which may be desirable in certain internal combustion engines due to an unusual shape and restricted installation area. By using the fuel injector as a direct-injector, the injection point may be optimally placed at a desired location in the combustion chamber. In conventional installation positions of injectors for intake manifold injections, such a design means that the fuel injector, along with its downstream end and thus its metering and injection section, extends well into the intake tube. As a result, by directing the injection to one or more intake valves, any wetting of the wall of the intake tube is largely avoided, and consequently the exhaust emissions of the internal combustion engine are reduced.

The use of the relatively inexpensive sleeve for valve seat support 16 eliminates the need for swivel parts commonly used in injectors, which parts are more voluminous due to their larger external diameter, and are more costly to manufacture than valve seat support 16.

A sealing element 41 located in a groove 40 on the outer circumference of valve seat support 16 acts as a seal between the circumference of the injector and a valve receptacle (not shown) in the cylinder head or in an intake manifold of the internal combustion engine. Sealing element 41 is made of a plastic such as PTFE, for example.

Valve seat support 16 is distinguished by the fact that at least one radially-outward-protruding raised section or convexity in the form of a bead 43 is provided which, for example, completely surrounds it in circumferential direction. Multiple radial beads 43 along the axial length of valve seat support 16 are also possible. In addition to the at least one radially-outward-protruding bead 43, multiple depressions in the form of crimps 44 may be provided which are distributed along the circumference and increase rigidity. These crimps 44 have a certain degree of longitudinal extension. Bead 43 is added to valve seat support 16, for example by rolling, and valve seat support may have been manufactured, for example, by deep drawing or from a tube by forming. Before the actual process of adjusting the valve lift, a preformed component already exists having at least one outward-facing raised section in the form of bead 43.

For the purpose of precisely adjusting the lift of valve needle 19, the circumference of valve seat support 16 is plastically deformed, specifically in the region of bead 43. As indicated by arrow 45, deforming of bead 43 is carried out by the radial action of force on bead 43. This approach allows the axial extension of valve seat support 16 to be modified extremely precisely and in a defined manner, specifically permitting it to be enlarged so as to allow for a very precise adjustment of the valve lift.

Before the deformation process of bead 43, an initial measurement is taken in a known manner of the static fuel quantity dispensed during the static opening state of the valve to obtain an actual value. This actual value is compared in a computer with a specified setpoint value for the fuel injected, and a setpoint lift for valve needle 19 is determined from this comparison. In another adjustment method, the actual lift of valve needle 19 is measured by a position sensor and compared in a computer with the specified setpoint lift. Based on the difference calculated by the computer between the actual lift and setpoint lift of valve needle 19, a control signal is generated which actuates a deformation tool 48. Deformation tool 48 is subsequently actuated to effect the plastic deformation of valve seat support 16, in such a manner and as long as required until the actual lift of valve needle 19 matches the setpoint lift.

Figure 2:
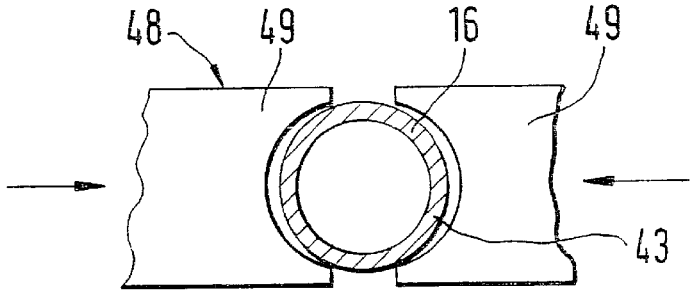
FIG. 2 shows a first example of a deformation tool.

FIGS. 2 through 5 show several methods of deforming valve seat support 16 according to the present invention in the region of bead 43 in order to adjust the valve lift. FIG. 2 shows deformation tool 48 having two half-shells 49. Both half-shells 49 have an internal concave region with which they may encompass bead 43 of valve seat support 16 over a large portion of its circumference. As indicated by the direction of the arrows, half-shells 49 apply a radial force to valve seat support 16, resulting in a modification of its axial length.

Figure 3:
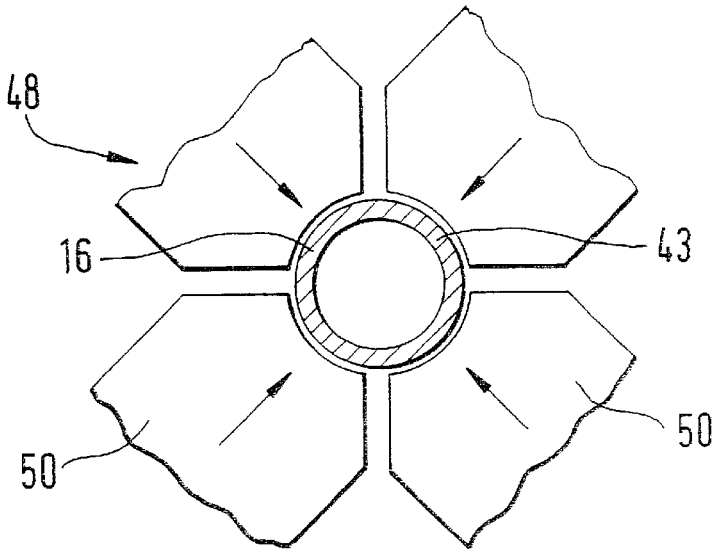
FIG. 3 shows a second example of a deformation tool.

FIG. 3 shows a comparable deformation tool 48, in which four tool segments 50, instead of two half-shells 49, engage valve seat support 16 in the region of bead 43. Again the arrows indicate the direction of the applied force. The four tool segments 50 each encompass approximately ¼ of the circumference of bead 43.

Figure 4:
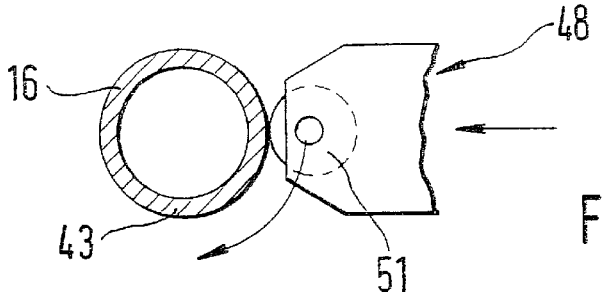
FIG. 4 shows a third example of a deformation tool.

FIG. 4 illustrates two methods of deformation. In a first variant, the valve is fixed in position in a manner not shown, and deformation tool 48 along with at least one roller 51 is moved in the direction of the radial arrow to valve seat support 16 where it circles valve seat support 16 so as to deform bead 43 in a circumferential direction as shown by the arrow. In a second variant, however, roller tool 48, 51 may be fixed while the valve is moved in the direction of roller tool 48, 51 and set in rotational motion. It is also possible to move both the valve, along with its valve seat support 16, as well as roller tool 48, 51 toward each other and set both in rotation.

Figure 5:
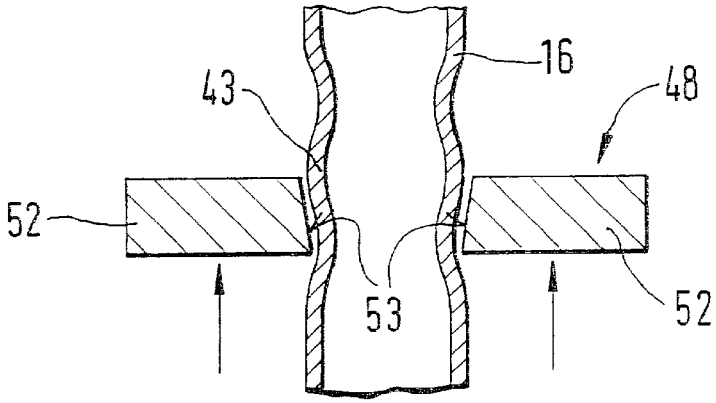
FIG. 5 shows a fourth example of a deformation tool.

FIG. 5 shows another deformation possibility. Here the application of force to bead 43 is effected in an axial direction by deformation tool 48. Deformation tool 48 having at least two tool segments 52, each of which has a conical inner surface 53 facing valve seat support 16 when deformation tool 48 is used. The conicity of tool segments 52 is designed so that upon the axial movement of tool segments 52, bead 43 is reduced in its radial height.

The deformation of bead 43 can also be effected by magnetic deformation. A locally restricted but strong magnetic field is generated in the region of bead 43. Since valve seat support 16 is ferritic, for example, the deformation of bead 43 and thus the valve lift may be precisely adjusted via the strength of the magnetic field.

The precision of the valve lift adjustment may be controlled by the geometry of bead 43 (for example, the slope angle and radius) or by the sheet thickness of valve seat support 16.

What is claimed is:

1. A method of adjusting a valve lift of an injector having a fuel intake, an energizable actuation device for moving a valve needle having a valve closing component, a fixed valve seat formed on a valve seat element and with which the valve closing component interacts to open and close a valve, a fuel outlet, and a connection piece having an internal longitudinal opening for accepting the valve needle and being one of directly connected and indirectly connected to the valve seat element, the method comprising the step of:

causing the valve needle to execute a lift between a valve closing position and a valve opening position, wherein:

the connection piece is premolded, with at least one radially-outward-protruding raised section being formed, and the at least one radially-outward-protruding raised section is plastically deformable in a radial direction toward the internal longitudinal opening in order to change the lift of the valve needle.

2. The method according to claim 1, wherein:

the injector is a fuel injector for an internal combustion engine.

3. The method according to claim 1, wherein:

the at least one radially-outward-protruding raised section includes a circumferential bead.

4. The method according to claim 1, wherein:

the at least one radially-outward-protruding raised section is applied by rolling.

5. The method according to claim 1, wherein:

a deformation of the at least one radially-outward-protruding raised section is performed with a deformation tool having two half-shells.

6. The method according to claim 1, wherein:

a deformation of the at least one radially-outward-protruding raised section is performed with a deformation tool that includes four tool segments.

7. The method according to claim 5, wherein:

the two half-shells include internal convex areas encompassing the at least one radially-outward-protruding raised section.

8. The method according to claim 6, wherein:

the four tool segments include internal convex areas encompassing the at least one radially-outward-protruding raised section.

9. The method according to claim 1, wherein:

a deformation of the at least one radially-outward-protruding raised section is performed with a deformation tool that, as a rolling tool, includes at least one roll acting upon the at least one radially-outward-protruding raised section.

10. The method according to claim 1, wherein:

a deformation of the at least one radially-outward-protruding raised section is performed with a deformation tool including at least two tool segments having conical interior surfaces.

11. The method according to claim 1, wherein:

a deformation of the at least one radially-outward-protruding raised section is performed by a magnetic deformation.

12. The method according to claim 1, wherein:

the connection piece is made of a ferritic material that conducts a magnetic flux.

* * * * *